United States Patent [19]

Chan

[11] 4,157,855

[45] Jun. 12, 1979

[54] ELECTRIC SOCKET AND PLUG

[76] Inventor: See F. Chan, 47-09 Newtown Rd., Astoria, N.Y. 11103

[21] Appl. No.: 834,189

[22] Filed: Sep. 19, 1977

[51] Int. Cl.[2] ..... H01R 13/62

[52] U.S. Cl. ..... 339/45 R; 339/75 P

[58] Field of Search ..... 339/45, 46, 75 P; 200/51.12; 285/DIG. 21; 337/16

[56] References Cited

U.S. PATENT DOCUMENTS

| | | | |
|---|---|---|---|
| 2,073,645 | 3/1937 | Maurer | 337/16 |
| 2,103,040 | 12/1937 | Radcliffe | 339/45 T |
| 2,654,865 | 10/1953 | Klug | 337/16 |
| 2,710,384 | 6/1955 | Dupre et al. | 339/45 M |
| 2,746,021 | 5/1956 | Butkovich | 339/45 R |
| 2,919,317 | 12/1959 | Mercer et al. | 339/45 R |
| 3,431,428 | 3/1969 | Van Valer | 339/45 M |
| 3,475,715 | 10/1969 | Venaleck | 339/45 R |

FOREIGN PATENT DOCUMENTS

| | | | |
|---|---|---|---|
| 961591 | 4/1957 | Fed. Rep. of Germany | 339/45 T |

*Primary Examiner*—Neil Abrams

[57] ABSTRACT

An electric socket adapted to receive a plug connected to the cord of an appliance such as a vacuum cleaner. In one embodiment of the invention there is provided in the socket a pair of bimetallic elements designed to deflect when heated causing the plug prongs to be released whereupon the plug is pushed from the socket under spring pressure. In other embodiments of the invention electromagnets are provided to cause the desired prong deflection for release of the plug. Appropriate circuitry is provided for the desired operation of the socket including release of the plug at remote as well as near locations with respect to the socket.

2 Claims, 3 Drawing Figures

ELECTRIC SOCKET AND PLUG

The invention relates to electrical apparatus and, in particular, to socket receptacles adapted to receive a cord plug to provide electrical energy for an appliance.

According to the invention the socket is provided with a slide member adapted to bear on one of the prongs of an electric plug inserted therein. In one embodiment the socket includes a pair of bimetallic retention elements which serve to retain a pair of the inserted prongs but release them when heated by a coil wound thereon allowing the slide member under spring pressure to move at the same time urging the plug from its socket. In another embodiment the slide member is actuated to eject the plug as the retention elements are deflected by a pair of electromagnets. In still another embodiment the slide member is solenoid operated. In several embodiments separate provision is made for electrically or manually removing the plug from the socket operable in its vicinity, such provision being useful, for example, in the event of breakdown of the primary plug ejection circuit or power failure.

One object of the invention is to provide a new and improved electric socket having specially associated elements which are capable of breaking its plug connection when activated from a location relatively remote therefrom.

Other objects and advantages of the invention may be appreciated on reading the following description of several embodiments thereof which are taken in conjunction with the accompanying drawings, in which.

Figure 1:
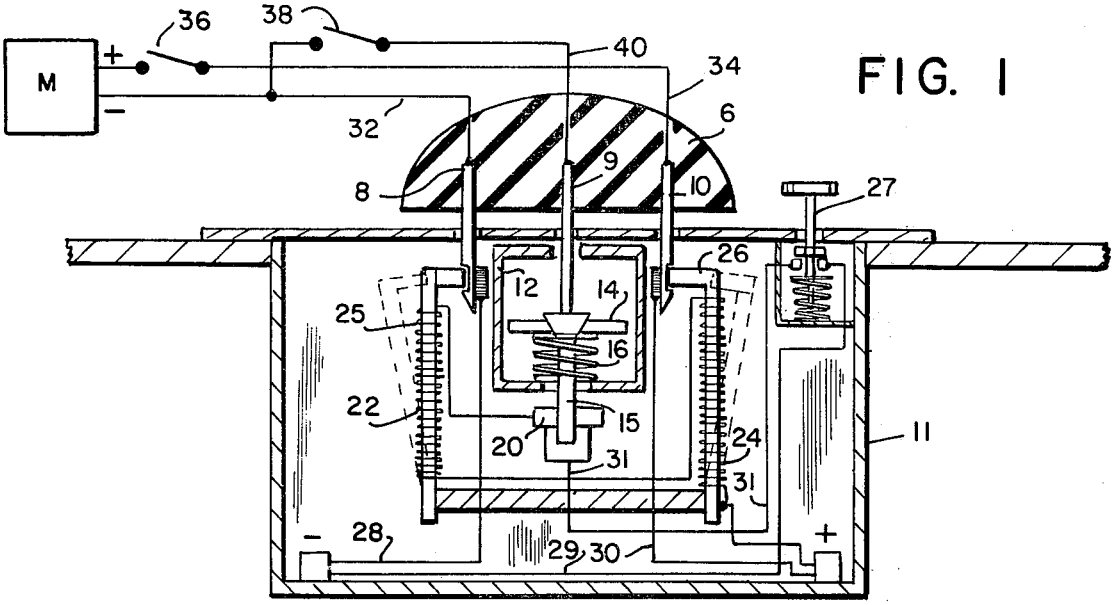
FIG. 1 is an elevation in partial section showing one embodiment of the combination plug and socket invention.

Referring to FIG. 1 of the drawings, plug 6 having prongs 8, 9 and 10 are shown in socket 11. These is contained in the socket a housing 12 in which there is provided a T shaped slidable push member 14 the bar of which extends through the bottom of the housing. Bearing against the cross piece of the member 14 is spring 16 which is disposed between the cross piece and the bottom of the housing. The bar element of slide member 14 is in continuous electrical contact with conductor ring 20 which is electrically connected directly by wire to coil 22 the latter being connected in turn to coil 24. The coils 22 and 24 are wound on bimetallic deflection bars 25 and 26, respectively, which constitute the outer walls of the socket, the free ends of which engage shoulders provided in prongs 8 and 10 with the plug inserted in the socket. With the plug 6 inserted in the socket appliance motor M operates as a consequence of current flow from the negative power terminal through lead 28, prong 8, lead 32, motor M and on the positive side through closed switch 36, lead 34, prong 10 and lead 30 to the positive power terminal.

The plug may be removed at the motor M by closing plug ejection switch 38 which establishes the following circuit. Current flows from the negative power terminal through lead 28, prong 8 and lead 32 to the closed switch 38 and thence on the other side of the line through lead 40, prong 9 bar 15, conductor 20 and the series connected coils 22 and 24 to the positive power terminal. Accordingly the bars 25 and 26 are laterally deflected to permit the member 14 to eject the plug under spring pressure due to its direct engagement with the prong 9.

A secondary prong release circuit is operated by spring backed switch 27 located at the proximate site of the socket 11. To that end the negative power terminal is connected to the switch 27 by lead 29 and to the ring conductor 20 by lead 31 and thence to the bar deflection coils 22 and 24, the latter being connected to the positive power terminal.

Figure 2:
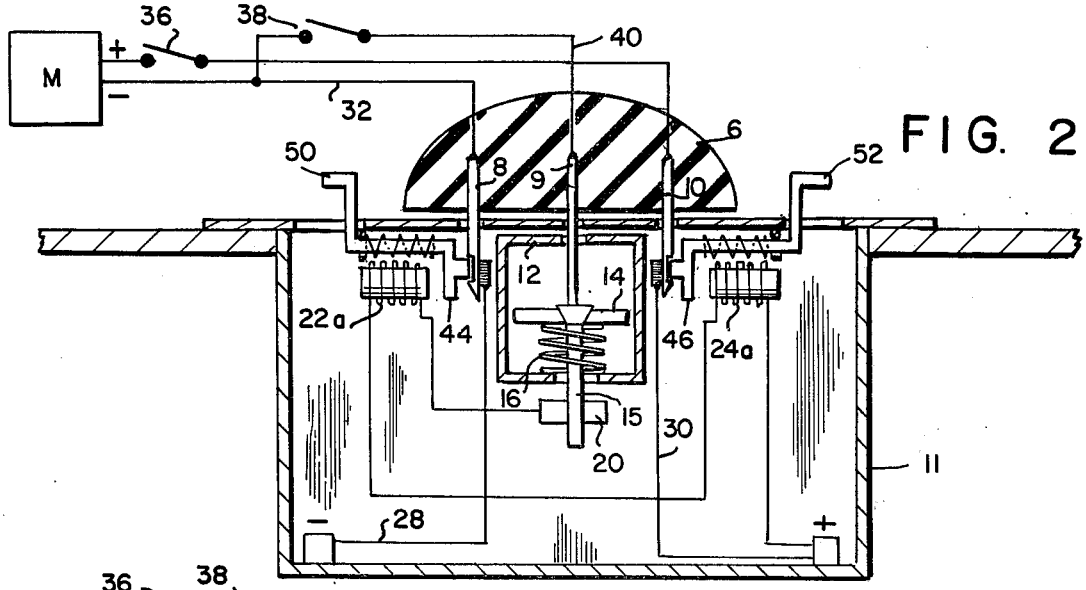
FIG. 2 shows a second embodiment of same.

In the embodiment shown in FIG. 2, coils **22*a* and 24*a* are wound respectively on the core of electromagnets. The latter when energized by closing switch 38 serve to draw detents 44 and 46 out of engagement with shoulders formed in the prongs 8 and 10. The prongs then break contact with terminal leads 28 and 30 and at the same time slide member 14 is urged outwardly under spring pressure to push on prong 9, the plug 6 being thereby released from the socket 11. The primary power and plug ejection circuitry is the same as in the embodiment of invention shown in FIG. 1 with the electromagnetic coils 22i a and 24*a* replacing the deflection coils 22 and 24. However, instead of a secondary electrical plug ejection means there is provided a manual ejector at the socket side. This consists of spring backed lateral slide elements 50 and 52 having depending extension elements which cause the detents to withdraw from the prongs 8 and 10 as the elements 50 and 52** are manually spread apart.

Figure 3:
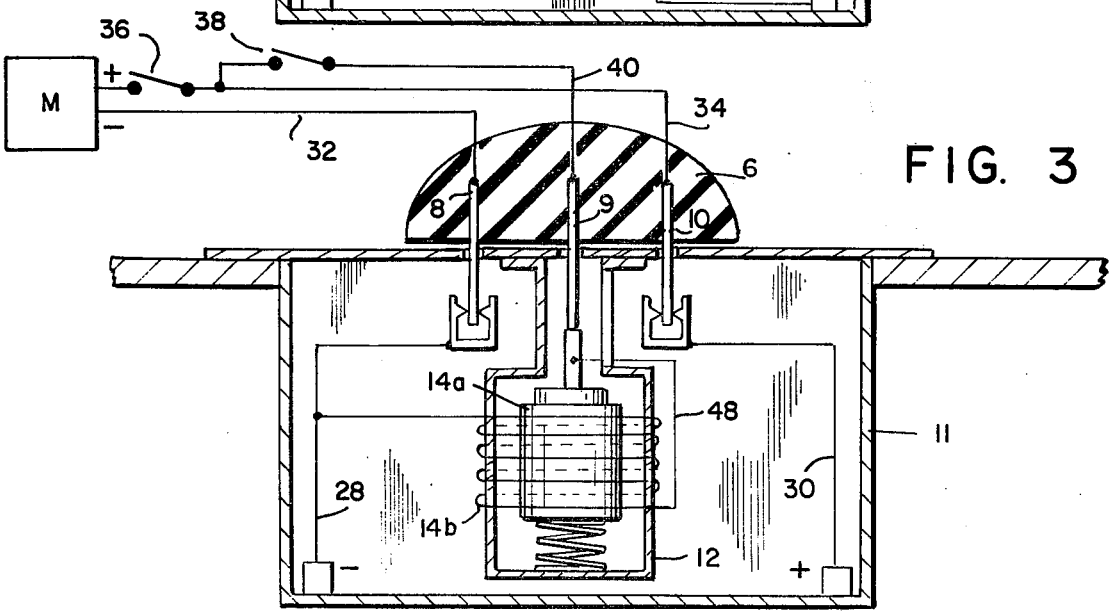
FIG. 3 shows a third embodiment of same.

In the embodiment shown in FIG. 3 slide member **14*a* is a solenoid having a coil 14*b* connected to the prong 9 by wire 48 and to the positive terminal by switch 38 through lead 34, prong 10 and lead 30. The coil is connected to the negative terminal by lead 28. Closing switch 38 causes the solenoid 14*a* to slide forwardly and push the plug from its socket. Closing switch 36 energizes the motor M due to the connection of negative and positive terminal leads 28 and 30 to the motor switch by means of prongs 8 and 10 and appliance cord wires 32 and 34**, respectively.

Various other embodiments of the invention may be effected by persons skilled in the art without departing from the scope and principle thereof as defined in the appended claims.

What is claimed is:

1. An electric socket comprising an outer casing, an inner housing, a slide member disposed in the housing and adapted to engage a prong of an electric plug, power terminals adapted to become electrically connected to other prongs of the plug, a spring in outwardly biasing engagement with said slide member, there being provided bimetallic bars adapted in normal position to retain said other plug prongs, there being a coil wound on each bar in electrical connection with said member which on energizing is adapted to cause the deflection of said bars from plug retaining position thereby permitting the slide member to dislodge the plug from said socket.

2. An electric socket comprising an outer casing, an inner housing, a slide member disposed in the housing and adapted to engage a prong of an electric plug, power terminals adapted to become electrically connected to other prongs of the plug, a spring in outwardly biasing engagement with said slide member, detents in normal engagement with each of said other prongs and electromagnets in electric connection with said member and in control of said detant of cause them to disengage from said other prongs permitting the slide member to dislodge the plug from the socket.

* * * * *